US006244639B1

(12) United States Patent
Storck

(10) Patent No.: US 6,244,639 B1
(45) Date of Patent: Jun. 12, 2001

(54) ICE GRIPPING DEVICE WITH HAND AND WRIST STRAPS

(76) Inventor: Kurt W. Storck, 33343 Lynx, Westland, MI (US) 48185

( * ) Notice: Subject to any disclaimer, the term of this patent is extended or adjusted under 35 U.S.C. 154(b) by 0 days.

(21) Appl. No.: 09/562,141

(22) Filed: May 1, 2000

(51) Int. Cl.[7] ..... B63C 9/32
(52) U.S. Cl. ..... 294/25; 441/82
(58) Field of Search ..... 294/1.1, 25, 26, 294/61; 2/16, 20, 21, 160, 161.1, 161.5, 161.6; 30/123.5, 164.5, 164.8, 298; 224/217, 218, 267; 441/80, 82

(56) References Cited

U.S. PATENT DOCUMENTS

| | | | | |
|---|---|---|---|---|
| 633,220 | * | 9/1899 | Sholl | 30/123.5 |
| 758,196 | * | 4/1904 | Thomas | 294/25 X |
| 767,918 | * | 8/1904 | Thomas | 30/123.5 |
| 810,098 | * | 1/1906 | Walter | 294/25 X |
| 816,681 | | 4/1906 | Piller . | |
| 966,641 | * | 8/1910 | Atkison | 30/123.5 |
| 1,274,481 | | 8/1918 | West . | |
| 1,583,754 | | 5/1926 | Rogers . | |
| 3,981,526 | | 9/1976 | Lundqvist . | |
| 4,157,616 | * | 6/1979 | Lundqvist | 294/25 X |
| 5,924,752 | | 7/1999 | Moody . | |

* cited by examiner

*Primary Examiner*—Johnny D. Cherry
(74) *Attorney, Agent, or Firm*—Dykema Gossett PLLC

(57) ABSTRACT

The ice gripping device is provided with hand and wrist straps and is designed to be worn on the hand or glove of the wearer. It includes an elastic hand strap designed to fit over the hand. It also includes a non-elastic heavy duty wrist strap having a pair of end portions, with one end portion folded over itself and having the end thereof secured by stitching to an intermediate portion of the wrist strap. A buckle is retained by the folded over end portion of the wrist strap and is engageable with the tab end of the strap to secure the wrist strap on the wrist or over the glove of the wearer. The hand and wrist straps are connected by a non-elastic connecting member having a pair of ends, with one end in surface-to-surface contact with the wrist strap. A generally flat metal plate has one or more perpendicular tines extending therefrom for gripping the ice. The other end of the non-elastic connecting member overlies the hand strap and the metal plate. Fastening members such as rivets extend through the connecting member, hand strap and metal plate to hold the metal plate in a fixed position relative to the hand and wrist straps.

20 Claims, 2 Drawing Sheets

ICE GRIPPING DEVICE WITH HAND AND WRIST STRAPS

FIELD OF THE INVENTION

This invention relates to a lifesaving device that can be worn on the hand and wrist of the wearer and more particularly to an ice gripping device having one or more tines which will assist the wearer when engaged in outdoor activities on the ice in extracting the wearer from a hole in the ice.

BACKGROUND OF THE INVENTION

Persons who are engaged in winter activities on frozen ponds, streams, lakes or rivers are concerned with breaking through thin ice and plunging into the freezing water. This is particularly true for those engaged in ice fishing, snowmobiling, hiking, ice skating and other such outdoor winter activities. It will be appreciated that the result of falling through the ice may result in death due to drowning or hypothermia. It is nearly impossible for an unaided individual to escape from the water because of slippery ice surrounding the hole, swift water currents beneath the ice, the cold temperature of the water or because a person is weighted down due to water-soaked clothing.

The prior art discloses several attempts to assist a person who may have fallen into icy water. U.S. Pat. No. 816,681 relates to a lifesaving apparatus which has a wrist band provided with several spikes for gripping the ice. Such a device is uncomfortable to wear and does not appear to be very effective for gripping the ice when a skater or other outdoor user attempts to extricate him or herself from the water.

U.S. Pat. No. 1,274,481 relates to an ice mitten which has a spiked hinge plate strapped to the wearer's wrist. Such a device is intended for use in handling pieces of ice. It would not be used by the wearer or user to pull himself or herself out of the hole in the ice. The spikes provided are not intended to bear the entire weight of the wearer. Also, the spikes are constantly exposed thereby making the ice mitten potentially hazardous and uncomfortable if it is worn at all times while the user is on the ice.

U.S. Pat. No. 1,583,754 relates to a sack grip having a palm piece with a number of pin points projecting therefrom for projecting into heavy sacks, as an example, those containing cement, grain, etc. The disclosed sack grip is not intended to be used as a ice gripping device.

U.S. Pat. No. 3,981,526 discloses a spike tool which consists of a partial glove having a spike protruding therefor. Such a spike tool appears to be uncomfortable to the wearer particularly when handling large objects or performing detailed jobs.

U.S. Pat. No. 5,929,752 relates to a safety device and in particular, to an ice gripping device having retractable prongs. The device is worn on the hand and arm of the wearer to assist the person who has fallen through a hole in the ice.

Thus, it is desirable to provide a lifesaving device for use by a person who has fallen through a hole in the ice and that can be worn comfortably, has sufficient strength and penetration ability to assist the wearer in extracting himself or herself from the hole when required.

SUMMARY OF THE INVENTION

It is a feature of the present invention to provide a lifesaving device that can be safely and comfortably worn on each hand and wrist of a person who is engaging in winter activities on frozen streams, ponds, lakes or rivers.

Another feature of the present invention is to provide a lifesaving device adapted to be worn by a person on the hand and wrist, with the device comprising an annular elastic hand strap designed to fit the hand of the wearer, with the hand strap having inner and outer surfaces.

Still another feature of the present invention is to provide a lifesaving device of the aforementioned type wherein a non-elastic wrist strap is provided having a pair of end portions, with one end portion folded over itself for retaining a buckle there between.

A further feature of the present invention is to provide a lifesaving device of the aforementioned type wherein a non-elastic connecting member is provided with a pair of ends, having one end in surface-to-surface contact with the wrist strap between the ends thereof.

A still further feature of the present invention is to provide a lifesaving device of the aforementioned type wherein a generally flat metal plate is provided having one or more tines extending therefrom for gripping the ice, with the plate being arranged in surface-to-surface contact with the outer surface of the hand strap.

Another feature of the present invention is to provide a lifesaving device of the aforementioned type wherein the other end of the non-elastic connecting member overlies the hand strap and the metal plate and all are connected together by fastening means such as rivets.

Still another feature of the present invention is to provide a lifesaving device which is simple in construction, easy to assembly, economical to manufacture and efficient in operation.

DETAILED DESCRIPTION OF THE PREFERRED EMBODIMENT

Figure 1:
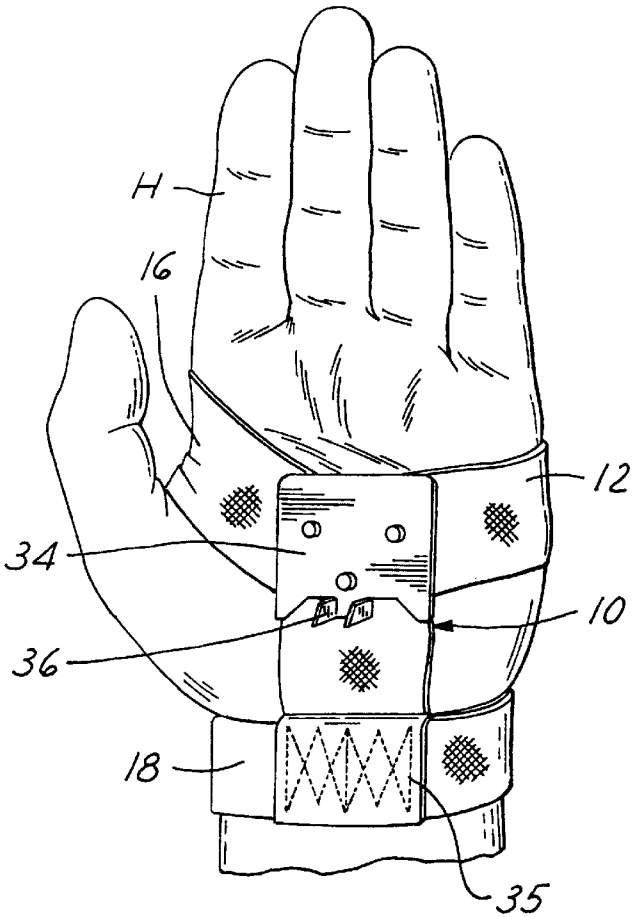
FIG. 1 is an elevational view of the palm of a person's left hand illustrating the lifesaving device applied to the hand with the elastic hand strap and non-elastic wrist strap in place and illustrating the metal plate and the projecting tines adjacent the heel of the hand.
Figure 2:
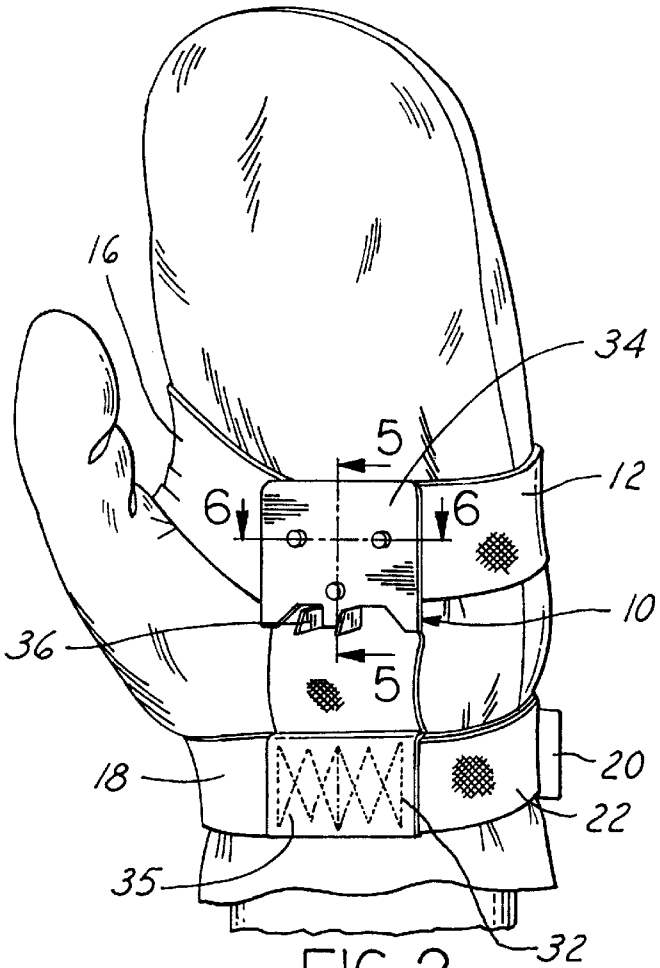
FIG. 2 is a front elevational view of a left hand with a mitten or glove thereon and with the lifesaving device superimposed on the glove, similar to FIG. 1.
Figure 5:
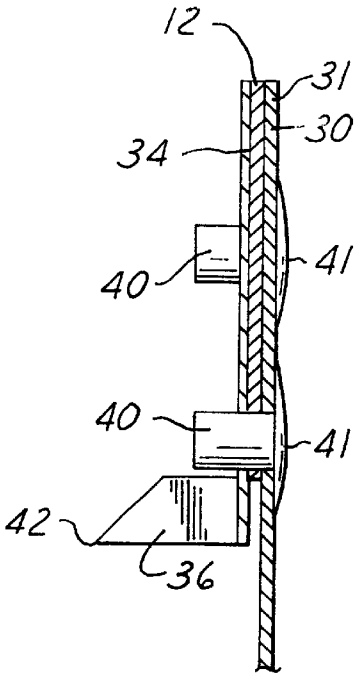
FIG. 5 is a sectional view taken on the lines 5—5 of FIGS. 2 and 4.
Figure 4:
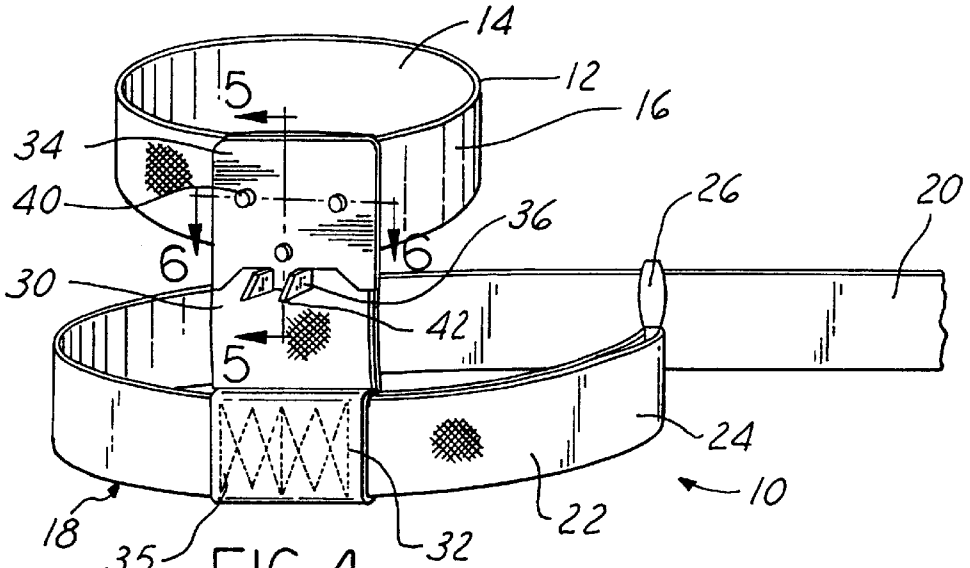
FIG. 4 is a perspective view of the lifesaving device showing the ice gripping tines with hand and wrist straps.
Figure 6:
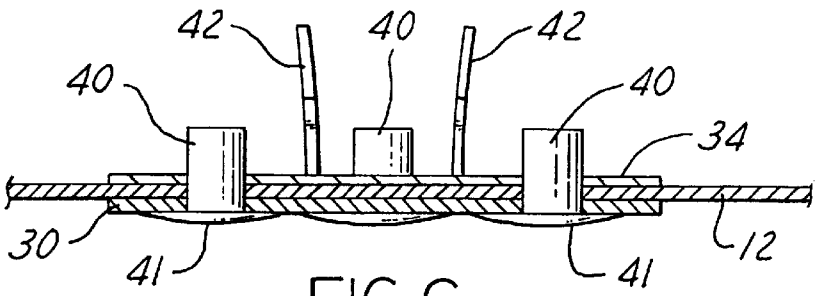
FIG. 6 is a sectional view taken on the lines 6—6 of FIGS. 2 and 4.
Figure 3:
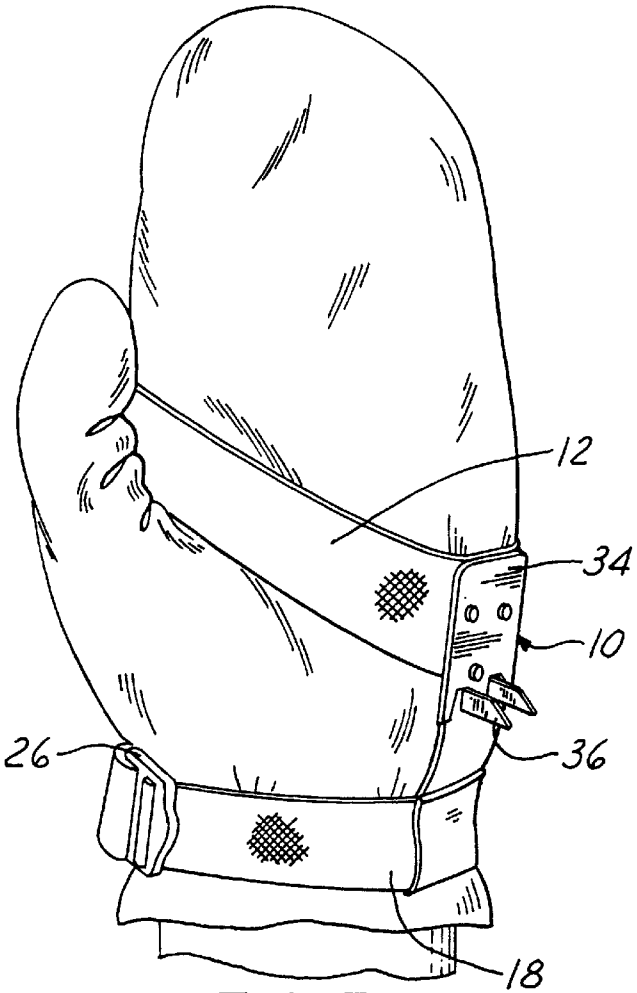
FIG. 3 is an elevational view of a left with a hand mitten or glove thereon showing the lifesaving device rotated approximately 900 from the position of FIG. 2 so that the metal plate and tines are at the side of the mitten.

Referring now to the drawings and in particular to FIG. 4, the lifesaving ice gripping device with hand and wrist straps is designated by the numeral 10. The device 10 is adapted to be worn on the hand as illustrated in FIG. 1 or on a glove or mitten as illustrated in FIGS. 2 and 3. The ice gripping device 10 may be mounted on the hand or glove, with the metal plate and tines at the heel of the hand or gloves (FIGS. 1 and 2) or at the side of the hand (FIG. 3) or glove so as to keep the tines out of the way of fingers when the hand is closed.

The device 10 includes an annular elastic or expandable hand strap 12 which is designed to fit over the hand H of the wearer. The hand strap has an inner surface 14 and an outer surface 16. The device 10 further includes a non-elastic heavy duty wrist strap 18 which has a pair of end portions 20 and 22. End portion 22 is folded over itself so as to form a generally U-shaped configuration 24 as best illustrated in FIG. 4. A plastic buckle 26 is retained by the U-shaped portion 24. The buckle 26 is engageable with the other end portion 20 in order to draw and to secure the wrist strap 18 to the wrist of the wearer as shown in FIGS. 1 and 3.

The lifesaving device 10 further includes a non-elastic connecting member 30 having a pair of ends 31 and 32, with one end 32 in surface-to-surface contact with the wrist strap 18 between the ends thereof as best illustrated in FIG. 4. The end 32 is wrapped around the wrist strap 18 and over the end of the U-shaped configuration portion 24 and is thereafter stitched at 35. The stitching 35 extends through four plies of material formed by the folded over wrist strap 18 and the wrapped non-elastic connecting member 30.

A generally flat metal plate 34 is provided. The plate 34 includes a pair of tines 36 which are struck out from the plate 34 and are arranged perpendicular to the plate as illustrated in FIG. 4. The plate 34 is located in surface-to-surface contact with the outer surface 16 of the elastic hand strap 12. The other end 31 of the non-elastic connecting member 30 overlies the hand strap 12 and the metal plate 34. Fastening means in the form of a plurality of rivets 40, with enlarged heads 41, extend through the non-elastic connecting member 30 to hold the metal plate 34 in a fixed position relative to the hand strap 12. Each tine 36 has a pointed edge 42 for assisting the wearer of the device 10 to grip the ice should the wearer fall through a hole into icy water. Each tine has a length from ⅛" to ½" in order to penetrate the ice.

The lifesaving device 10 may be worn in two positions. In the first position, as shown in FIG. 1, the metal plate 34 overlies the heel of the hand. It should also be appreciated that the device 10 in FIG. 1 may be rotated approximately 90° whereby the metal plate 34 overlies the side of the hand opposite the thumb. FIGS. 2 and 3 illustrates a person with a glove or mitten, with the lifesaving device 10 mounted on the mitten. In FIG. 2, the metal plate 34 overlies the heel of the hand and the glove while in FIG. 3 the metal plate 34 overlies the side of the glove and hand.

In use, a wearer may mount the lifesaving device 10 on one hand or a pair of devices on both hands prior to engaging in activities on the ice. The tines 36 are oriented such that they overlie the heel or side of the hand or glove. When a person falls through a hole in the ice when wearing the lifesaving devices 10, the person simply extends the hands through the hole and swings the hands onto the ice thereby providing the wearer with the ability to grip the edges of a hole in the ice. This provides extra gripping ability which will assist the wearer in extricating himself/herself from the freezing water.

The present invention provides an inexpensive, lifesaving device that overcomes the limitations and disadvantages of existing devices by utilizing a device that is comfortable to wear and has the tines so located on the device so as to assist the person in extricating himself/herself from a hole in the ice. It is important for an outdoor winter sports person to remember not to go onto the ice without the ice gripping devices having been first applied to the hands and wrists.

It should be recognized that modifications of the present invention may be made by a person skilled in the art without departing from the spirit or scope of this invention.

What I claim is:

1. A lifesaving device to be worn on the hand and wrist of the wearer comprising:

(a) an annular elastic hand strap designed to fit over the hand of the wearer, said hand strap having inner and outer surfaces;

(b) a non-elastic wrist strap having a pair of end portions, with one end portion folded over itself and having the end thereof secured to an intermediate portion of said wrist strap;

(c) a buckle retained by said folded-over end portion of said wrist strap and engageable with a tab end of the other end portion to secure the wrist strap on the wrist of the wearer;

(d) a non-elastic connecting member having a pair of ends, with one end in surface-to-surface contact with said wrist strap between the ends thereof;

(e) a generally flat metal plate having one or more perpendicular tines extending therefrom for gripping ice, said plate being in surface-to-surface contact with the outer surface of said hand strap;

(f) the other end of said non-elastic connecting member overlying said hand strap and said metal plate; and (g) fastening means extending through said connecting member, said hand strap and said metal plate to hold said metal plate in a fixed position relative to said hand strap.

2. The lifesaving device of claim 1 wherein said fastening means are in the form of rivets which extend through said connecting member, said hand strap and said metal plate.

3. The lifesaving device of claim 2 wherein a plurality of rivets are employed.

4. The lifesaving device of claim 1 wherein said metal plate has a pair of perpendicular tines, with each tine having a pointed edge for assisting the wearer of the device to grip the ice should the wearer have fallen into icy waters.

5. The lifesaving devices of claim 4 wherein said pair of perpendicular tines are stuck out of said metal plate.

6. The lifesaving device of claim 1 wherein said device is worn over a glove or mitten which is provided for the wearer's hand, with the metal plate overlying the side of the hand and mitten.

7. The lifesaving device of claim 1 wherein a glove or mitten is provided for the wearer's hand with the device worn over the glove and having the metal plate overlying the heel of the hand and the glove.

8. The lifesaving device of claim 1 wherein said one end of said non-elastic connecting member is wrapped around said wrist strap and is secured thereto by stitching.

9. The lifesaving device of claim 1 wherein each tine has a length from ⅛" to ½" in order to penetrate the ice.

10. A lifesaving device to be worn on the hand and wrist of the wearer comprising:

(a) an annular elastic hand strap designed to fit over the hand of the wearer, said hand strap having inner and outer surfaces;

(b) a non-elastic wrist strap having a pair of end portions, with one end portion folded over itself and having the end thereof secured to an intermediate portion of said wrist strap;

(c) a buckle retained by said folded-over end portion of said wrist strap and engageable with a tab end of the other end portion to secure the wrist strap on the wrist of the wearer;

(d) a non-elastic connecting member having a pair of ends, with one end in surface-to-surface contact with said wrist strap between the ends thereof;

(e) a generally flat metal plate having one or more perpendicular tines extending therefrom for gripping ice, said plate being in surface-to-surface contact with the outer surface of said hand strap;

(f) the other end of said non-elastic connecting member overlying said hand strap and said metal plate;

(g) fastening means extending through said connecting member, said hand strap and said metal plate to hold said metal plate in a fixed position relative to said hand strap;

(h) said metal plate having a pair of perpendicular tines, with each tine having a pointed edge for assisting the wearer of the device to grip the ice should the wearer have fallen into icy waters; and (i) said one end of said non-elastic connecting member being wrapped around said wrist strap and secured thereto by stitching.

11. The lifesaving device of claim 10 wherein said fastening means are in the form of rivets which extend through said connecting member, said hand strap and said metal plate.

12. The lifesaving device of claim 11 wherein a plurality of rivets are employed.

13. The lifesaving device of claim 10 wherein said device is worn over a glove or mitten which is provided for the wearer's hand, with the metal plate overlying the side of the hand and mitten.

14. The lifesaving device of claim 10 wherein a glove or mitten is provided for the wearer's hand with the device worn over the glove and having the metal plate overlying the heel of the hand and the glove.

15. The lifesaving device of claim 10 wherein each tine has a length from ⅛" to ½" in order to penetrate the ice.

16. A lifesaving device to be worn on the hand and wrist of the wearer comprising:

(a) an annular elastic hand strap designed to fit over the hand of the wearer, said hand strap having inner and outer surfaces;

(b) a non-elastic wrist strap having a pair of end portions, with one end portion folded over itself and having the end thereof secured to an intermediate portion of said wrist strap;

(c) a buckle retained by said folded-over end portion of said wrist strap and engageable with a the tab end of the other end portion to secure the wrist strap on the wrist of the wearer;

(d) a non-elastic connecting member having a pair of ends, with one end in surface-to-surface contact with said wrist strap between the ends thereof;

(e) a generally flat metal plate having one or more perpendicular tines extending therefrom for gripping ice, said plate being in surface-to-surface contact with the outer surface of said hand strap;

(f) the other end of said non-elastic connecting member overlying said hand strap and said metal plate;

(g) fastening means extending through said connecting member, said hand strap and said metal plate to hold said metal plate in a fixed position relative to said hand strap;

(h) said fastening means are in the form of rivets which extend through said connecting member, said hand strap and said metal plate;

(i) said metal plate having a pair of perpendicular tines, with each tine having a pointed edge for assisting the wearer of the device to grip the ice should the wearer have fallen into icy waters; and (j) said pair of perpendicular tines being stuck out of said metal plate.

17. The lifesaving device of claim 16 wherein a plurality of rivets are employed.

18. The lifesaving device of claim 16 wherein said device is worn over a glove or mitten which is provided for the wearer's hand, with the metal plate overlying the side of the hand and mitten.

19. The lifesaving device of claim 16 wherein a glove or mitten is provided for the wearer's hand with the device worn over the glove and having the metal plate overlying the heel of the hand and the glove.

20. The lifesaving device of claim 16 wherein said one end of said non-elastic connecting member is wrapped around said wrist strap and is secured thereto by stitching.

* * * * *